US011458743B2

(12) United States Patent
Heinze

(10) Patent No.: US 11,458,743 B2
(45) Date of Patent: Oct. 4, 2022

(54) DRYER UNIT AND PRINTING MACHINE

(71) Applicant: BOBST BIELEFELD GMBH, Bielefeld (DE)

(72) Inventor: Rene Heinze, Vlotho (DE)

(73) Assignee: BOBST BIELEFELD GMBH, Bielefeld (DE)

( * ) Notice: Subject to any disclaimer, the term of this patent is extended or adjusted under 35 U.S.C. 154(b) by 0 days.

(21) Appl. No.: 17/361,021

(22) Filed: Jun. 28, 2021

(65) Prior Publication Data

US 2022/0001681 A1 Jan. 6, 2022

(30) Foreign Application Priority Data

Jul. 1, 2020 (EP) ..... 20183374

(51) Int. Cl.
*B41J 11/00* (2006.01)
*B41F 23/04* (2006.01)

(52) U.S. Cl.
CPC ..... *B41J 11/00222* (2021.01); *B41F 23/0466* (2013.01)

(58) Field of Classification Search
CPC ..... B41J 11/00222; B41F 23/0466; B41F 23/0463; B41F 23/0423
See application file for complete search history.

(56) References Cited

U.S. PATENT DOCUMENTS 10,286,687 B2 * 5/2019 Perez Gellida ..... F26B 21/00
2007/0125876 A1 6/2007 Bolling et al.

FOREIGN PATENT DOCUMENTS

| | | | |
|---|---|---|---|
| DE | 1542417 | A1 | 4/1970 |
| DE | 2458001 | A1 | 6/1976 |
| EP | 0103876 | A2 | 3/1984 |
| EP | 0787964 | A1 | 8/1997 |
| EP | 0807591 | A1 | 11/1997 |
| WO | 2019166129 | A1 | 9/2019 |

* cited by examiner

*Primary Examiner* — Bradley W Thies
(74) *Attorney, Agent, or Firm* — Bookoff McAndrews, PLLC

(57) ABSTRACT

A dryer unit (18) for applying a dryer gas to a sheet material inside a printing machine comprises a dryer body (20) having a first set (26) of dryer gas output openings (28). These openings (28) are arranged in a substantially regular pattern covering an application width (20*a*) of the dryer unit (18). Additionally, at least one dryer gas output slot (38) is arranged upstream the first set (26) of dryer gas output openings (28). Furthermore, a printing machine is presented which comprises such a dryer unit (18).

11 Claims, 2 Drawing Sheets

DRYER UNIT AND PRINTING MACHINE

CROSS-REFERENCE TO RELATED APPLICATION(S)

Figure 1:
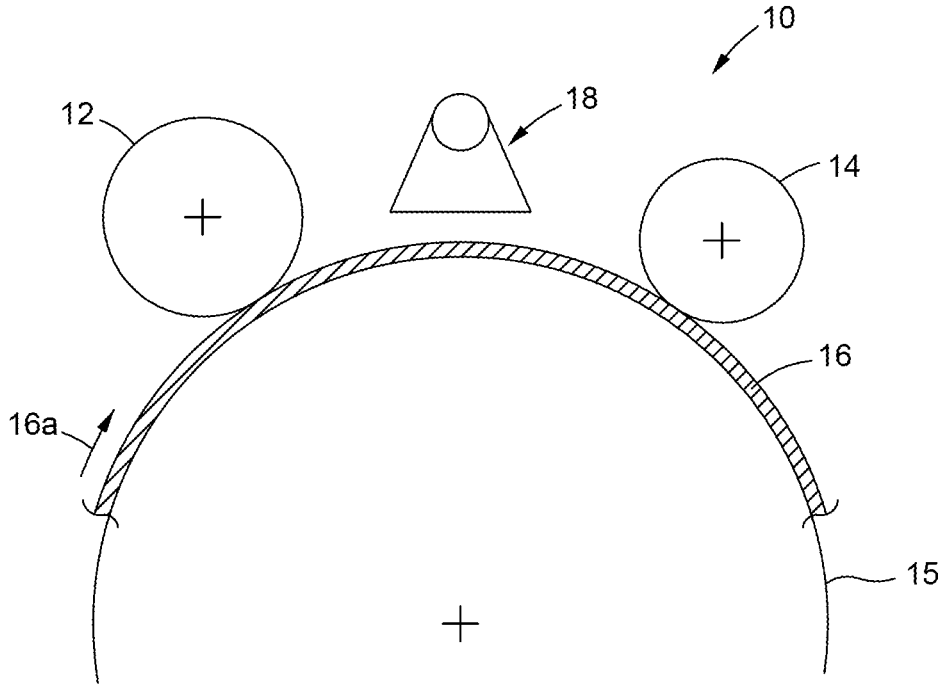

This application claims the benefit of priority under 35 U.S.C. § 119 from European Patent Application No. 20183374.6, filed on Jul. 1, 2020, the contents of which is incorporated by reference in its entirety.

The invention relates to a dryer unit for applying a dryer gas to a sheet material inside a printing machine. The dryer unit comprises a dryer body having a first set of dryer gas output openings being arranged in a substantially regular pattern covering an application width of the dryer unit.

Additionally, the invention relates to a printing machine comprising such a dryer unit.

Such dryer units and printing machines equipped therewith are known in the art. In this context, the application width of the dryer unit corresponds to a maximum width of sheet material to be dried with the dryer unit. With respect to the printing machine the application width usually is the same as the maximum sheet width or slightly larger than that.

Dryer units are used for drying ink after a printing process. It is for this reason that the overall productivity of a printing machine is strongly dependent on the performance of the dryer unit. Subsequent printing steps and/or coiling steps often may only take place if the sheet material and the ink applied thereto is completely dry. Consequently, the maximum speed at which sheet material may travel through a printing machine may be limited by the performance of the dryer unit.

At the same time the application of dryer gas must not damage the sheet material or a layer of freshly applied ink. Therefore, temperature and pressure of the dryer gas are limited. The same applies to a volume flow rate of the dryer gas.

The problem to be solved by the present invention is to provide a dryer unit with increased drying performance. Simultaneously the boundaries mentioned above must be respected. Especially, negative effects of the dryer gas on the sheet material and the ink applied thereto must be avoided.

The problem is solved by a dryer unit of the type mentioned above, wherein at least two dryer gas output slots are arranged upstream the first set of dryer gas output openings. In this context, the term upstream is to be understood in respect of the travelling direction of the sheet material. Since the slot is provided in addition to the dryer gas output openings a volume flow rate of dryer gas applied to the sheet material may be increased without increasing the pressure or temperature thereof. Consequently, drying performance is enhanced while the sheet material is not additionally stressed. Furthermore, the dryer gas exiting the slot may be used in order to break an air stream resulting from the movement of the sheet material. As a consequence thereof the dryer gas exiting the dryer gas output openings can be applied in a more effective and precise way. Also this effect leads to high dryer performance. Consequently, the overall productivity of a printing machine equipped with such a dryer unit is enhanced.

The dryer gas output openings and/or the dryer gas output slots may be openings of corresponding nozzles. Thus, the dryer gas may exit the dryer gas output openings and/or the dryer gas output slot at relatively high speed and with a precise orientation.

The dryer gas output openings may have a substantially circular cross section, especially wherein the dryer gas output openings form a rectangular pattern. Such openings may be produced with standard manufacturing machinery. Consequently, manufacturing is relatively simple and low-cost. The arrangement of the openings in a rectangular pattern leads to a uniform drying result over the entire application width of the dryer unit.

By using at least two dryer gas output slots over the print width, the dryer gas exiting the slots may be well distributed over the application width of the dryer unit.

Preferably according to the invention all slots are arranged upstream the first set of dryer gas output openings.

Alternatively, or additionally, neighboring dryer gas output slots are offset with respect to each other in a direction substantially perpendicular to the width direction and/or the slots are inclined with respect to the width direction. In doing so manufacturing of the slots is facilitated since small webs between neighboring slots are avoided. At the same time, a continuous application of dryer gas to the sheet material may still be ensured.

According to an embodiment, the dryer gas output slot extends substantially in a width direction of the dryer. Consequently, the dryer gas exiting the slot may be applied over a substantial part of the application width of the dryer unit or even the entire application width. Both alternatives lead to good drying performance being uniformly distributed.

Neighboring slots may overlap in the width direction. This ensures continuous application of dryer gas to the sheet material. Potential gaps in regions between the slots are eliminated. Consequently, a good drying performance is achieved over the entire application width.

If the slots are inclined, they are preferably inclined by an angle of less than 45°, preferably less than 30° and more preferably less than 20°, with respect to the width direction. This allows for a compact design of the dryer unit while maintaining the effects and advantages mentioned above.

In a variant a second set of dryer gas output openings is provided downstream the first set of dryer gas output openings on the dryer body. The dryer gas output openings of the second set form a substantially regular pattern covering the application width of the dryer unit. As a consequence thereof, an additional volume flow of dryer gas can be applied to the sheet material. Consequently, drying performance is increased.

In an alternative, a separation section is interposed between the first set and the second set of dryer gas output openings, especially wherein the separation section does not comprise openings. This further improves the dryer performance since dryer gas having been discharged from the first set of dryer gas output openings, which may be loaded with humidity and other ink residues may flow away from the sheet material before dryer gas is discharged from the second set of dryer gas output openings. Additionally, the separation section helps distributing the application of dryer gas over a bigger area. Consequently, the sheet material experiences less stress resulting from the dryer unit.

All gas output openings and gas output slots are supplied with gas via a pressurized gas supply space arranged inside the dryer body. The elements of the dryer body forming the gas supply space may be at least partially connected via latching noses and/or latching hooks made from polymer material. If the gas supply space needs to be opened, e.g. for maintenance reasons, the latching noses and/or latching hooks may be destroyed. When compared to the state of the art solution, where the elements of the dryer body forming the gas supply space are connected via screws, which usually are secured by screw locking, the destruction of the latching noses and/or latching hooks is a lot easier and faster. Furthermore, the latching noses and/or latching hooks are cheaper than the known screws.

Moreover, a first set of gas suction openings can be provided in the area of the first set of dryer gas output openings and/or a second set of gas suction openings can be provided in the area of the second set of dryer gas output openings. The gas suction openings help evacuating dryer gas being loaded with humidity and/or ink residues. Consequently, such gases are not released to the environment in an uncontrolled manner.

The first set of gas suction openings and/or the second set of gas suction openings may form a substantially regular pattern covering the application width of the dryer unit. The arrangement of the suction openings in a regular pattern leads to a uniform evacuation of dryer gas over the entire application width of the dryer unit. Preferably, the suction openings have a substantially rectangular cross section. Such suction openings may be produced with standard manufacturing machinery. Consequently, manufacturing is relatively simple and low-cost.

In an alternative a third set of gas suction openings is provided upstream the slots, especially wherein the third set of gas suction openings comprises a line of gas suction openings extending over the application width of the dryer unit. Thus, it is avoided that dryer gas being loaded with humidity and/or ink residues is released to the environment in an area upstream the slots.

In a preferred embodiment the line of gas suction openings is a single line. This allows for a compact design of the dryer unit.

Furthermore, the problem is solved by a printing machine of the type mentioned above comprising a dryer unit according to the invention. The dryer unit is especially an intermediate dryer unit. Such a printing machine is highly productive since known constraints imposed thereon by known dryer units are released. Furthermore, the dryer unit according to the invention is very compact and offers high precision drying results. Consequently, it can be used as an intermediate dryer unit which is arranged in between two printing units, e.g. printing different colors. Such a dryer may also be called an intracolor dryer.

Figure 2:
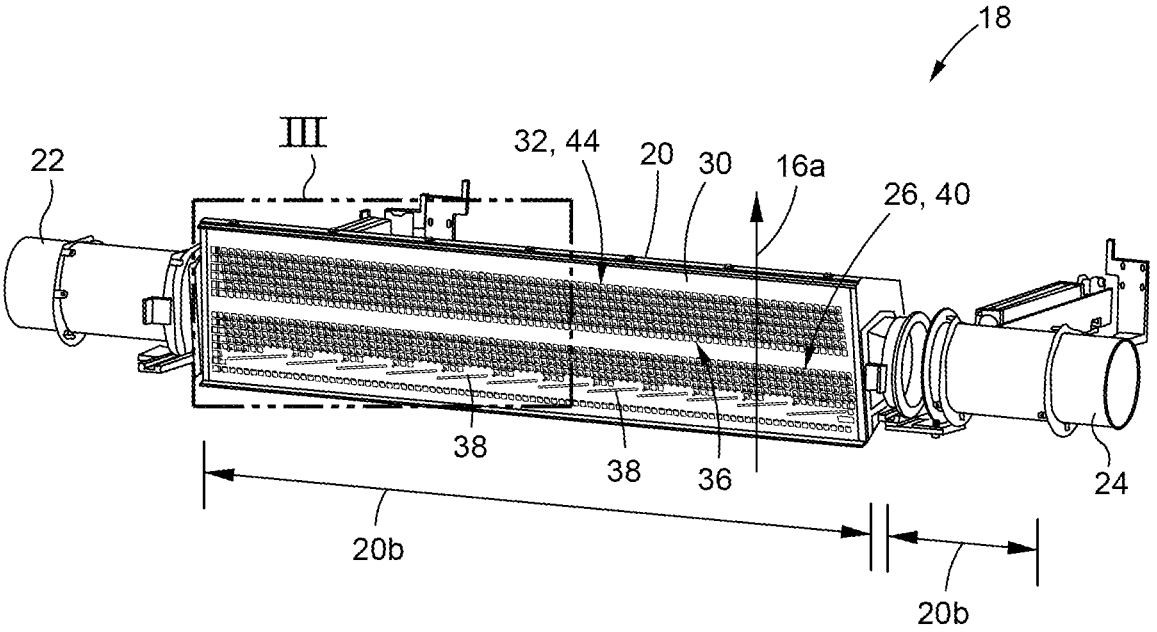
Figure 3:
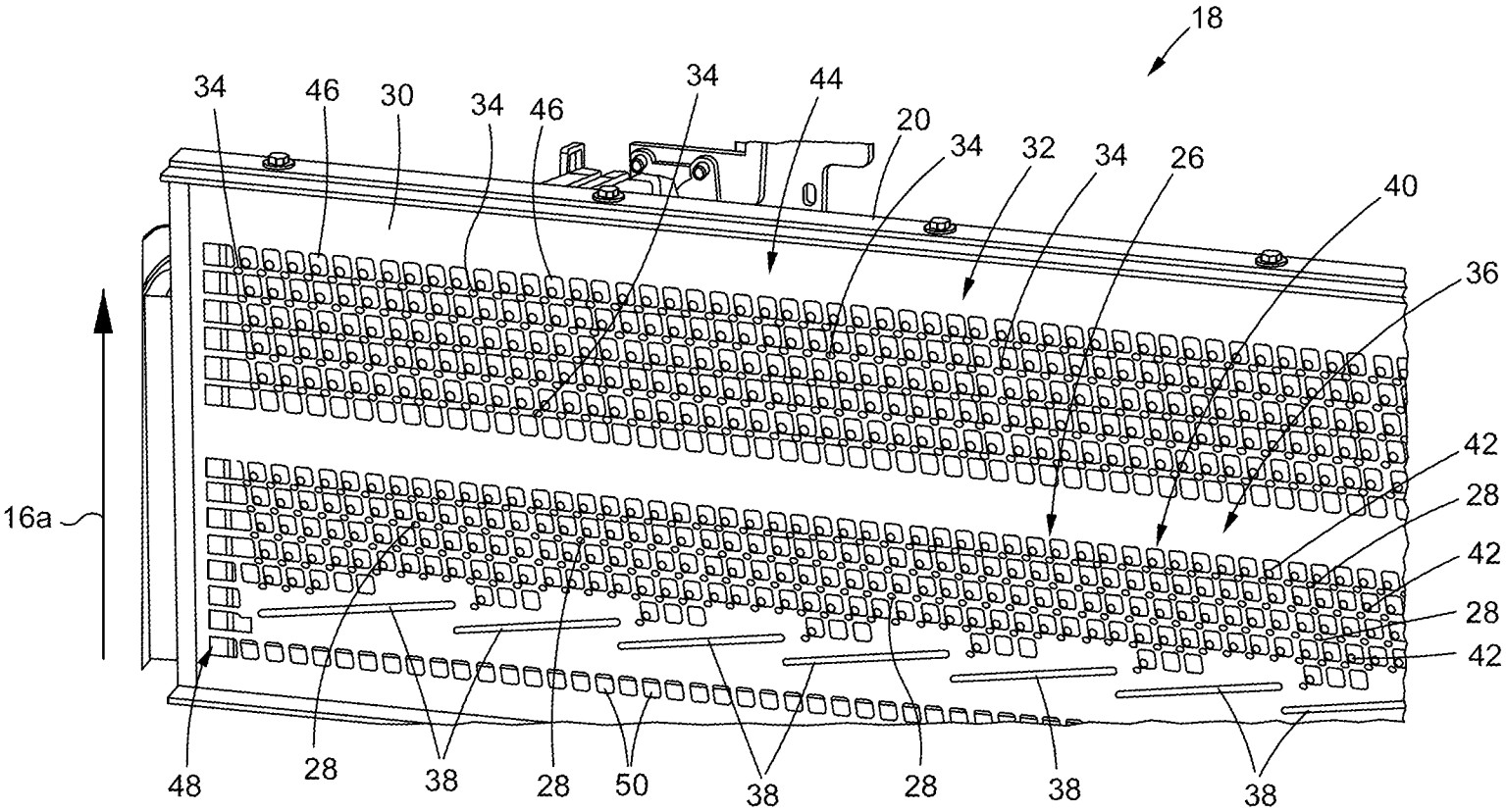

The invention will now be described with reference to the enclosed drawings. In the drawings, FIG. 1 schematically shows a printing machine according to the invention comprising a dryer unit according to the invention, wherein the dryer unit is an intermediate dryer, FIG. 2 shows the dryer unit of FIG. 1 in a more detailed perspective view, and FIG. 3 shows a detail III of FIG. 2.

FIG. 1 shows a part of a central drum printing machine 10 having a first printing unit 12 and a second printing unit 14, wherein the two printing units 12, 14 are configured for printing ink of different color on a sheet material 16 which travels through the printing machine 10 along a direction 16*a* over a central drum 15.

The printing machine 10 also comprises a dryer unit 18 which is an intermediate dryer unit being configured for drying ink applied to the sheet material 16 by the first printing unit 12 before the respective part of the sheet material enters the second printing unit 14.

Even though the sheet material 16 is represented as a continuous web of sheet material, the printing machine 10 may also be configured for processing single sheets thereof.

The dryer unit 18 may be seen in in more detail in FIGS. 2 to 3.

It comprises a dryer body 20 extending substantially over an application width 20*a* of the dryer unit 18. The application width 20*a* is oriented along a width direction 20*b* of the dryer unit 18.

In the example the application width 20*a* corresponds to the width of the sheet material 16. In other words, the dryer unit 18 is configured for supplying a dryer gas over the entire with of the sheet material 16 in order to dry ink applied thereto.

To this end the dryer body 20 is equipped with a dryer gas inlet port 22 which may be connected to a pump supplying dryer gas to dryer unit 18.

The dryer body 20 is also equipped with a dryer gas outlet port 24 being configured for discharging dryer gas which is loaded with humidity and residues of ink as will be explained later.

In order to apply the dryer gas to the sheet material 16 a first set 26 of dryer gas output openings 28 is provided on a discharge side 30 of the dryer body 20 (cf. FIG. 3). For the ease of representation only some of the dryer gas output openings 28 are equipped with a reference sign.

The dryer gas output openings 28 are arranged in a rectangular pattern comprising four full lines of dryer gas output openings 28, each of them covering the application width 20*a*. Additionally, a fifth line of dryer gas output openings 28 is provided, only comprising some gas output openings 28, i.e. not being fully staged with gas output openings 28.

Each of the dryer gas output openings 28 has a substantially circular cross section and all these dryer gas output openings 28 are fluidically connected to the dryer gas inlet port 22.

Additionally, a second set 32 of dryer gas output openings 34 is provided on the discharge side 30 of the dryer body 20 (cf. FIG. 3). Again, only some of the dryer gas output openings 34 are equipped with a reference sign for the ease of representation.

The second set 32 is arranged downstream the first set 26, wherein a separation section 36 is interposed between the first set 26 and the second set 32.

The separation section 36 does not comprise any openings.

Also the dryer gas output openings 34 of the second set 32 form a substantially rectangular pattern comprising five lines of dryer gas output openings 34 covering the application width 20*a* of the dryer unit 18.

Each of the dryer gas output openings 34 has a substantially circular cross section and all these dryer gas output openings 34 are fluidically connected to the dryer gas inlet port 22.

Furthermore, a series of dryer gas output slots 38 is arranged upstream the first set 26 of dryer gas output openings 28.

All dryer gas output slots 38 extend substantially in the width direction 20*b* of the dryer unit 18 and are slightly inclined with respect thereto.

Moreover, the slots 38 are arranged such that neighboring slots 38 overlap in the width direction 20*b*.

In other words, adjacent ends of neighboring slots 38 are offset with respect to each other in a direction substantially perpendicular to the width direction 20*b*.

All slots 38 are fluidically connected to the dryer gas inlet port 22.

It is noted that the dryer gas output openings 28, the dryer gas output openings 34 and the dryer gas output slots 38 are connected to the dryer gas inlet port 22 via a supply duct being located inside the dryer body 20.

Consequently dryer gas is applied to the sheet material 16 by the slots 38, the openings 28 and the openings 34 while the sheet material 16 travels in the direction 16*a* besides the discharge side 30 of the dryer body 20. Thereby ink applied to the sheet material 16 is dried.

In order to evacuate dryer gas being loaded with humidity and ink residues, a first set 40 of gas suction openings 42 is provided in the area of the first set 26 of dryer gas output openings 28.

These gas suction openings 42 are arranged in a rectangular pattern covering the application width 20*a* of the dryer unit 18. Moreover, the gas suction openings 42 are arranged such that the dryer gas output openings 28 are arranged in between the gas suction openings 42. This is the case in the width direction 20*b* and in a direction perpendicular to the width direction 20*b*.

Furthermore, the gas suction openings 42 of the first set 40 are all fluidically connected to the outlet port 24. Consequently, during operation of the dryer unit 18 the dryer gas applied to the sheet material by the dryer gas output openings 28 and at least a portion of the dryer gas applied to the sheet material 16 by the dryer gas output slots 38 will be evacuated via the gas suction openings 42 after having interacted with the sheet material 16.

Moreover, a second set 44 of gas suction openings 46 is provided in the area of the second set 32 of dryer gas output openings 34.

Also these gas suction openings 46 are arranged in a rectangular pattern covering the application width 20*a* of the dryer unit 18. Like the gas suction openings 42, the gas suction openings 46 are arranged such that the dryer gas output openings 34 are arranged in between the gas suction openings 46. This is the case in the width direction 20*b* and in a direction perpendicular to the width direction 20*b*.

Also the gas suction openings 46 of the second set 44 are all fluidically connected to the outlet port 24. Thus, during operation of the dryer unit 18 the dryer gas applied to the sheet material by the dryer gas output openings 34 will be evacuated via the gas suction openings 46 after having interacted with the sheet material 16.

A supplementary third set 48 of gas suction openings 50 is provided upstream the dryer gas output slots 38.

In the example shown these gas suction openings 50 are arranged along a single line extending over the application width 20*a* of the dryer unit 18.

These gas suction openings 50 are fluidically connected to the outlet port 24 and will evacuate dryer gas having been applied to the sheet material 16 by the slots 38.

The suction openings 42 of the first set 40, the suction openings 46 of the second set 44 and the suction openings 50 of the third set 48 have a substantially rectangular cross section.

The invention claimed is:

1. A dryer unit for applying a dryer gas to a sheet material inside a printing machine, the dryer unit comprising:

a dryer body having a first set of dryer gas output openings, the first set of dryer gas output openings being arranged in a substantially regular pattern covering an application width of the dryer unit; and at least two dryer gas output slots arranged upstream the first set of dryer gas output openings, wherein neighboring dryer gas output slots of the at least two dryer gas output slots are offset with respect to each other in a direction substantially perpendicular to a width direction and/or the neighboring dryer gas output slots are inclined with respect to the width direction.

2. The dryer unit of claim 1, wherein each of the first set of dryer gas output openings have a substantially circular cross section, and the first set of dryer gas output openings form a rectangular pattern.

3. The dryer unit of claim 1, wherein, the at least two dryer gas output slots extend substantially in the width direction.

4. The dryer unit of claim 1, wherein the neighboring dryer gas output slots overlap in the width direction.

5. The dryer unit of claim 1, further comprising:

a second set of dryer gas output openings provided downstream the first set of dryer gas output openings on the dryer body, wherein the second set of dryer gas output openings form a substantially regular pattern covering the application width of the dryer unit.

6. The dryer unit of claim 5, further comprising:

a separation section interposed between the first set of dryer gas output openings and the second set of dryer gas output openings, wherein the separation section does not comprise openings.

7. The dryer unit of claim 1, further comprising:

a first set of gas suction openings provided in a first area of the first set of dryer gas output openings, and/or a second set of gas suction openings is provided in a second area of the second set of dryer gas output openings.

8. The dryer unit of claim 7, wherein the first set of gas suction openings and/or the second set of gas suction openings form a substantially regular pattern covering the application width of the dryer unit.

9. The dryer unit of claim 7, wherein each of the first set of gas suction openings and/or the second set of gas suction openings have a substantially rectangular cross section.

10. The dryer unit of claim 7, further comprising:

a third set of gas suction openings provided upstream the at least two dryer gas output slots, wherein the third set of gas suction openings comprises a line of gas suction openings extending over the application width of the dryer unit.

11. A printing machine comprising:

a dryer unit according to claim 1, wherein the dryer unit is an intermediate dryer unit.

* * * * *